US006119755A

United States Patent [19]

Oskam

[11] Patent Number: 6,119,755

[45] Date of Patent: Sep. 19, 2000

[54] SUPPORT STRUCTURE FOR AN ARCHITECTURAL COVERING

[75] Inventor: Herman Oskam, Vlist, Netherlands

[73] Assignee: Hunter Douglas International N.V., Netherlands Antilles

[21] Appl. No.: 09/231,198

[22] Filed: Jan. 14, 1999

[30] Foreign Application Priority Data

Jan. 14, 1998 [EP] European Pat. Off. ..... 98200076

[51] Int. Cl.[7] ..... E06B 9/262

[52] U.S. Cl. ..... 160/84.02; 160/84.06

[58] Field of Search ..... 160/84.02, 84.03, 160/84.04, 84.05, 84.06, 265, 173 R, 177 R

[56] References Cited

U.S. PATENT DOCUMENTS

| | | | |
|---|---|---|---|
| 2,059,134 | 10/1936 | Metcalf . | |
| 2,328,305 | 8/1943 | De Stefano . | |
| 2,498,079 | 2/1950 | Hunter | 160/177 R |
| 2,874,771 | 2/1959 | Muhr . | |
| 3,630,264 | 12/1971 | Debs | 160/177 R |
| 4,333,510 | 6/1982 | Fox . | |
| 4,457,351 | 7/1984 | Anderson . | |
| 4,621,673 | 11/1986 | Georgopoulos et al. . | |
| 4,683,933 | 8/1987 | Dunbar . | |
| 4,762,159 | 8/1988 | Ford | 160/84.06 |
| 4,850,414 | 7/1989 | Lessard . | |
| 4,852,627 | 8/1989 | Peterson et al. . | |
| 5,178,200 | 1/1993 | Hagen | 160/84.02 X |
| 5,267,598 | 12/1993 | Marocco . | |
| 5,379,825 | 1/1995 | Jelic . | |
| 5,515,898 | 5/1996 | Alcocer | 160/84.02 |
| 5,538,066 | 7/1996 | Liu | 160/173 R |

FOREIGN PATENT DOCUMENTS

| | | |
|---|---|---|
| 15 09 451 | 9/1972 | Germany . |
| 28 05 469 | 8/1978 | Germany . |
| 89 00 257 | 11/1989 | Germany . |
| 92 09 608 | 7/1992 | Germany . |
| 145634 | 1/1972 | Netherlands . |
| 1 081 288 | 8/1967 | United Kingdom . |
| 1 134 303 | 11/1968 | United Kingdom . |
| 2076454 | 12/1981 | United Kingdom . |

*Primary Examiner*—David M. Purol
*Attorney, Agent, or Firm*—Dorsey & Whitney LLP

[57] ABSTRACT

A cradle for supporting a rotating member in a rail of an architectural covering includes a pair of bearing blocks positioned in side-by-side relationship, and a web portion that connects a base portion of each of the pair of bearing blocks on opposite sides of the cradle, and at least one break-line for separating the bearing blocks. Each of the bearing blocks has a flange extending perpendicularly from its base portion and is adapted to rotatably support the rotating member. At least one of the base portions has an aperture to receive a driving cord therethrough.

16 Claims, 6 Drawing Sheets

SUPPORT STRUCTURE FOR AN ARCHITECTURAL COVERING

CROSS-REFERENCE TO RELATED APPLICATION

This application corresponds to and claims priority to European application no. 98200076.2, filed Jan. 14, 1998. This European application is hereby incorporate by reference as though fully set forth herein.

BACKGROUND AND BRIEF SUMMARY OF THE INVENTION

This invention relates to an architectural covering, especially a covering for an architectural opening such as a window blind or shade, with two oppositely fixed rails and a movable rail arranged for parallel movement therebetween.

Such architectural coverings are known from U.S. Pat. Nos. 4,850,414 and 4,852,627. These architectural coverings have usually required a large number of parts and have not always been easily adaptable to window areas of non-rectangular shape.

In accordance with one aspect of this invention, an architectural covering is provided comprising:

a fixed first rail;

a movable second rail, extending parallel to the fixed first rail;

a fixed cord guide member spaced from the fixed first rail and positioned beyond the movable second rail;

a collapsible and extendible blind or shade which is positioned between the fixed first rail and the movable second rail;

at least one rotary drive spool mounted on the fixed first rail;

at least one driving cord that is wound on the rotary drive spool and is operatively connected to the movable second rail; and means for reversibly rotating the rotary drive spool to drive the driving cord and to effect movement of the movable second rail to collapse or extend the blind or shade; wherein the driving cord extends in an endless loop from the rotary drive spool towards the movable second rail, then towards the guide member and then from the guide member back to the rotary drive spool. Advantageously, the fixed cord guide member is on a fixed auxiliary third rail that is spaced from, and parallel to, the movable second rail and is on the side thereof remote from the fixed first rail. In this regard, it is particularly advantageous that the fixed cord guide member be on a longitudinal end of the fixed auxiliary third rail.

This invention also relates to a cradle with a modular bearing block for use in an architectural covering of this invention.

A bearing block for an architectural covering is known from GB patent 2 076 454. This bearing block can be used to guide and support the lift and tilt cords in a venetian blind and support a drum at both longitudinal ends. It is, however, rather difficult to use this bearing block where the drum is to be supported at one longitudinal end only.

In accordance with another aspect of this invention we provide a cradle for supporting a rotating member in a rail of an architectural covering; the cradle comprising:

a pair of bearing blocks positioned in side-by-side relationship; and a web portion that connects a base portion of each of the pair of bearing blocks on opposite sides of the cradle and at least one break-line for separating the bearing blocks; each of the bearing blocks having a flange extending perpendicularly from its base portion and adapted to rotatably support the rotating member; and at least one of the base portions having an aperture to receive a driving cord therethrough.

Advantageously, the modular bearing block and cradle are in a fixed rail of the architectural covering, a pair of substantially parallel break-lines are provided for separating the bearing blocks, each of the base portions has an opening for a driving cord, the rotating member is a rotating drive spool and each flange is provided with a bearing recess to rotatably support a journal of the rotating drive spool, and the flanges extend perpendicularly from edge portions on opposite sides of the web portion.

Further aspects of the invention will be apparent from the detailed description below of particular embodiments and the drawings thereof, in which:

DESCRIPTION OF THE PREFERRED EMBODIMENTS

Figure 1:
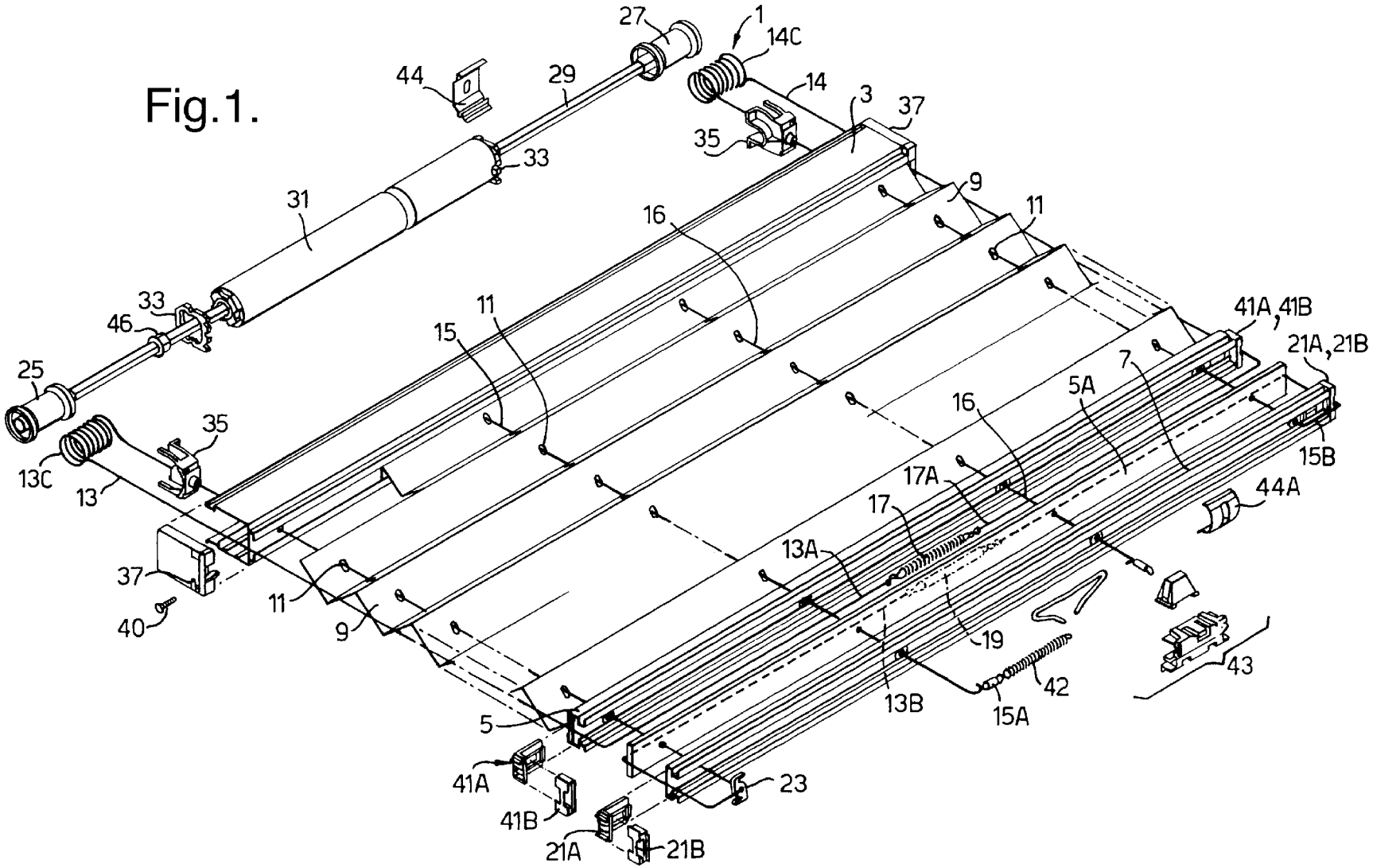
FIG. 1 is a detailed exploded view of a first embodiment of a shade assembly of the invention.

FIG. 1 shows a shade assembly 1 of the invention which includes: a fixed rail 3 that is preferably a top rail; a movable intermediate rail 5 that is movable while remaining parallel to the fixed rail 3; and a fixed auxiliary rail 7. Rail 7 is spaced from and parallel to the fixed rail and intermediate rail 5 and is positioned on the side thereof remote from the fixed rail 3 and is preferably a bottom rail. The shade assembly 1 has a generally rectangular form to correspond to a rectangular window opening (not shown). Suspended between the fixed rail 3 and the movable rail 5 is a conventional pleated shade 9 which is collapsible and extendible. The shade 9 is provided with a plurality of openings 11 for the passage of a pair of parallel, preferably vertical, driving cords 13,14 for moving or guiding the movable rail 5 and for the passage of a pair of parallel, preferably vertical, stationary support cables 15,16, between the driving cords, to support the shade 9 in the form of a pleated panel. Such an arrangement of cords and cables 13–16 is well known in the art and is therefore not shown or described in detail. In this regard, additional driving cords and support cables could, if desired, be provided.

One end 13A of the first driving cord 13 is attached to the left end of a first tension spring 17 which is retained within the movable rail 5. The other end 13B of the first driving cord 13 is attached to the left end of a second tension spring 19 which is similarly retained in the movable rail 5. The right ends of the first and second tension springs 17,19 are attached to the opposite ends 14A,14B respectively of the second driving cord 14. The arrangement of the connected opposite cord ends 13A,13B,14A,14B to the first and second, tension springs 17,19, which have limited movement within the movable rail 5, is equivalent in principle to having the opposite cord ends attached to the movable rail 5. Simultaneous movement of the driving cords 13,14 in one direction or the other will effectively move the movable rail 5 in one direction or in the opposite direction.

Figure 2:
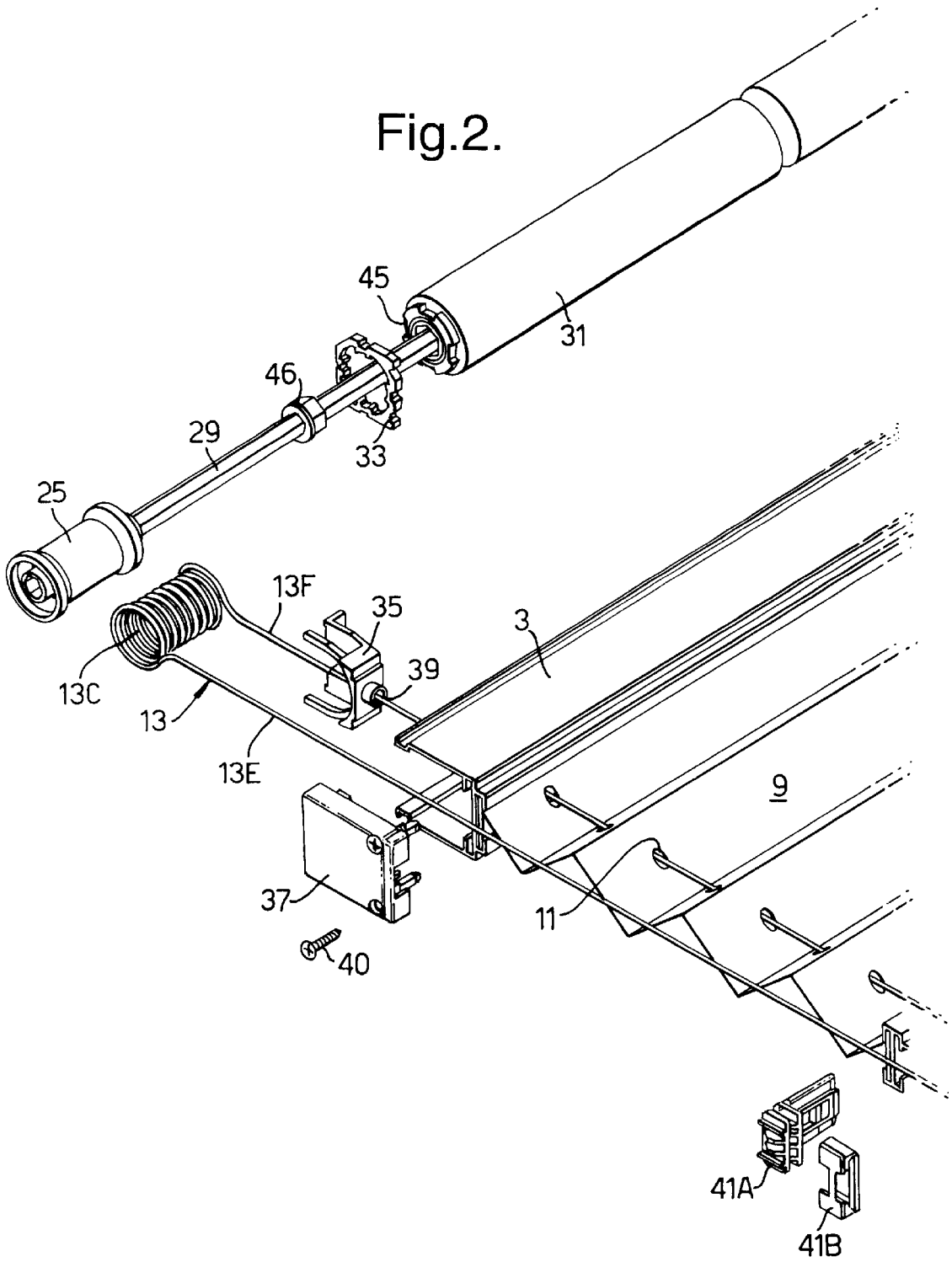
FIG. 2 is an enlarged view of a portion of FIG. 1, showing, in particular, a cord winding drum arrangement.
Figure 2A:
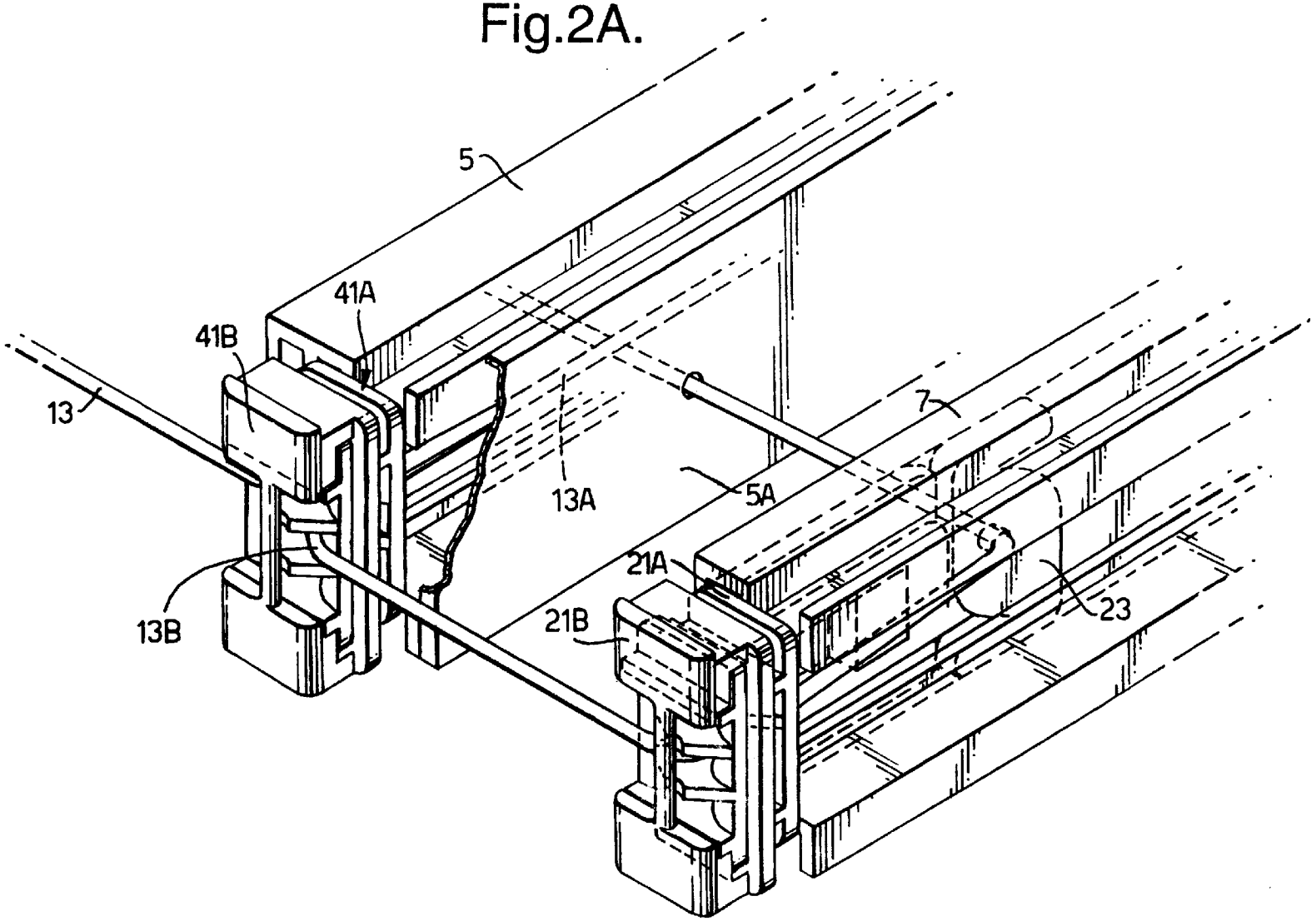
FIG. 2A is an enlarged view of another portion of FIG. 1, showing details of various guide members and their association with the driving cords.

As also shown in FIG. 1 and FIG. 2A, the cord end 13B of the first driving cord 13 is guided, in the shade assembly 1, firstly through a cord guide member in the form of first and second parts 41A,41B on the movable rail. It then passes through a fixed cord guide member in the form of a first conventional two-part end cap 21A,21B at each longitudinal end of the fixed auxiliary rail 7, then through a conventional grommet 23 auxiliary rail 7, then through the fixed auxiliary rail itself and then returned from there to the fixed rail 3, via an opening in the movable rail 5. A similar routing path is provided for the second driving cord 14 in the shade assembly 1 as shown in FIG. 1.

Figure 5:
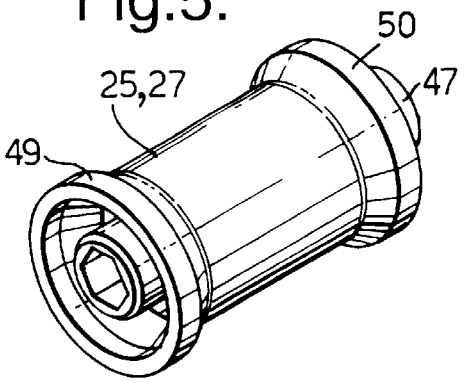
FIG. 5 is a perspective view of a first type of winding drum for use with the first embodiment of the shade assembly of FIGS. 1–3.

Within the fixed rail 3, a plurality of turns 13C, 14C of each driving cord 13,14 are wound around a different one of a pair of winding drums or rotary drive spools 25,27, respectively, shown in FIG. 5. Each of the winding drums 25,27 is adjacent one of the longitudinal ends of the fixed rail 3. The winding drums 25,27 are driven through a hexagonal drive shaft 29 that is, in turn, driven by a conventional electric motor 31. The electric motor 31 could, if desired, be replaced by a manually operated driving system for reversibly rotating the winding drums 25,27. The electric motor 31, as shown, is received in a pair of mounting supports 33 which are receivable within the contoured profile of the fixed rail 3.

With the electric motor 31 in position within the fixed rail 3, each winding drum 25,27 and its turns 13C,14C of one of the driving cords 13,14 are received between an identical bearing block 35 and an identical end cap 37 at opposite longitudinal ends of the fixed rail 3. As described in more detail below with reference to FIGS. 7 and 8, each bearing block 35 is provided with an aperture 39 for the passage of one of the driving cords 13,14. Each end cap 37 is conventional and is attached to each end of fixed rail 3 by means of screws 40.

Like the fixed auxiliary rail 7, the movable rail 5 is provided at its longitudinal ends with a second pair of conventional two-part end caps 41A,41B. The second end caps 41A,41B of the movable rail 5 can be identical to the first pair of two-part end caps 21A,21B on the fixed auxiliary rail 7.

As further shown in FIG. 1, one end 15A of one of the stationary support cables 15 extends in a loop through the fixed rail 3 and then is attached to the left end of a third tension spring 42. The right end of the third tension spring 42 is attached to, and tensioned by, a tensioning slider 43. Details of such a tensioning slider 43 for tensioning the support cable 15 are described in EP 0 860 577.

Still further shown in FIG. 1 is a cover strip 5A (shown as partially cut-away) which can be attached to the movable rail 5, adjacent the fixed auxiliary rail 7. The cover strip 5A serves to conceal the first and second tensioning springs 17,19 and the portions of the driving cords 13,14 within the movable rail 5.

Yet further shown in FIG. 1 are brackets 44,44A for mounting the adjacent fixed rail 3 and fixed auxiliary rail 7, respectively, to a support surface (not shown), for example adjacent to an architectural opening such as a window. Details of suitable brackets 44,44A are described in EP 0 862 881.

FIG. 2 shows the left-hand upper portion of the shade assembly of FIG. 1. The first drive cord 13 is wrapped around its winding drum 25 in a plurality of turns 13C. When retracting the shade 9 by moving the movable rail 5 towards the fixed rail 3, a portion 13E of the first drive cord 13 is wound onto the winding drum 25, and a portion 13F of the first drive cord 13 is unwound from the drum 25. In deploying the shade 9, the movable rail 5 is drawn towards the fixed cord guide members formed by the first pair of end caps 21A,21B on the fixed auxiliary rail 7, and the cord portions 13E and 13F thereby move in opposite directions. The motor 31 is adapted to reversibly power the winding drums 25,27 for rotation in opposite directions. In this regard, the motor 31 has a hexagonal bore 45 and an adapter 46 matched to fit the hexagonal shaft 29 connected to each winding drum 25,27.

Figure 3:
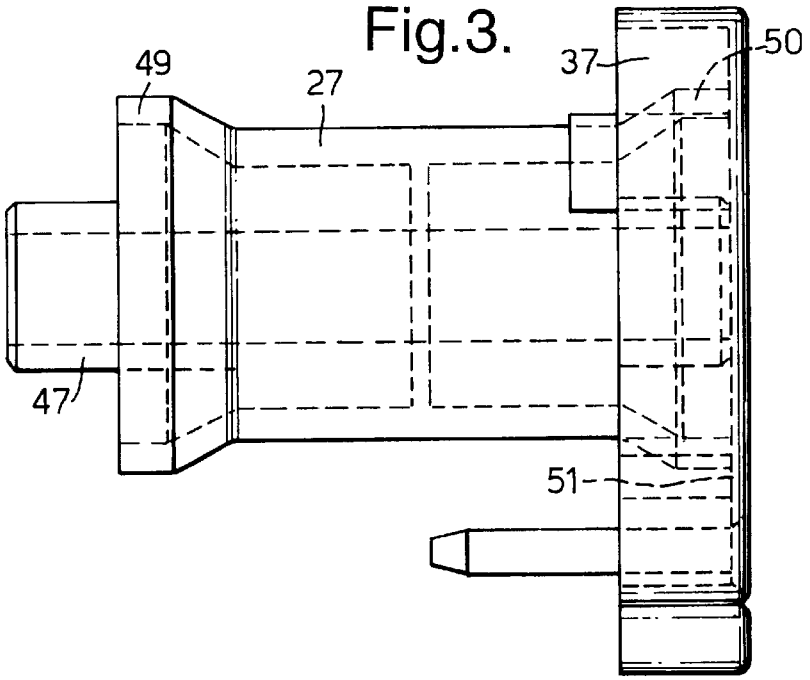
FIG. 3 is a ghost view through the cord winding drum and an end cap in which it is rotatably received.

FIG. 3 shows the second winding drum 27 in engagement with an adjacent end cap 37 on the fixed rail 3. It is seen that the drum 27, which is identical to drum 25, has an extended journal 47 on one end and a pair of flange portions 49,50 on opposite ends. The extended journal 47 is adapted to be received in the bearing block 35 shown in FIGS. 1 and 2. The flange portion 50 on the end opposite to the journal 47 is rotatably supported on an internal ridge structure 51 provided within the adjacent end cap 37.

Figure 4:
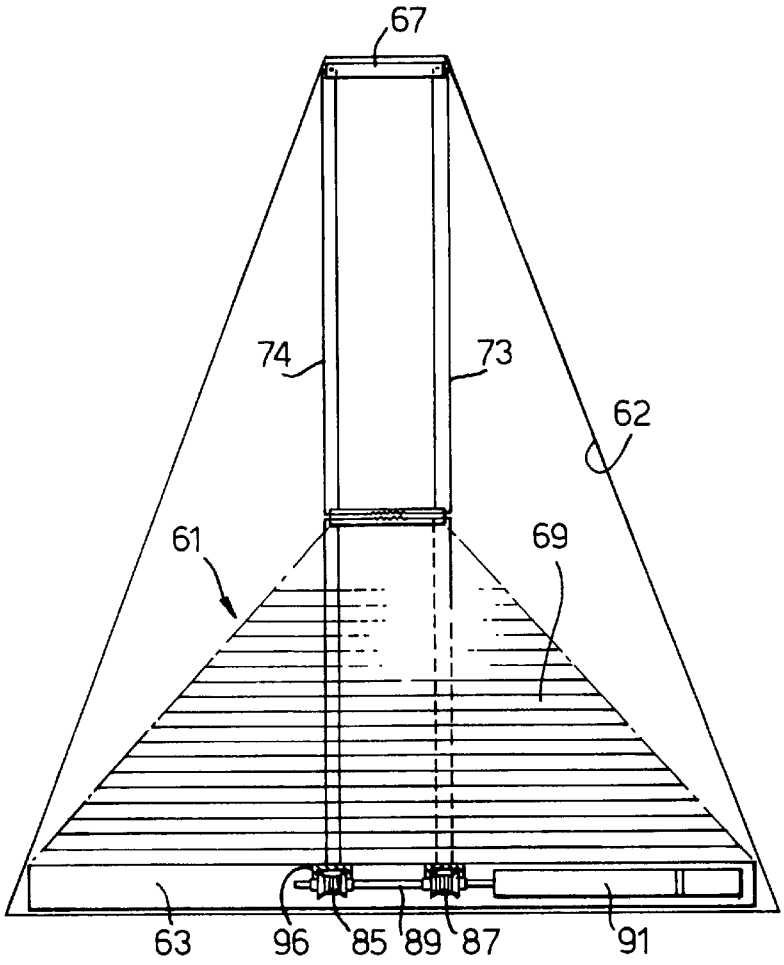
FIG. 4 is a schematic elevation of a second embodiment of a shade assembly of the invention.
Figure 4A:
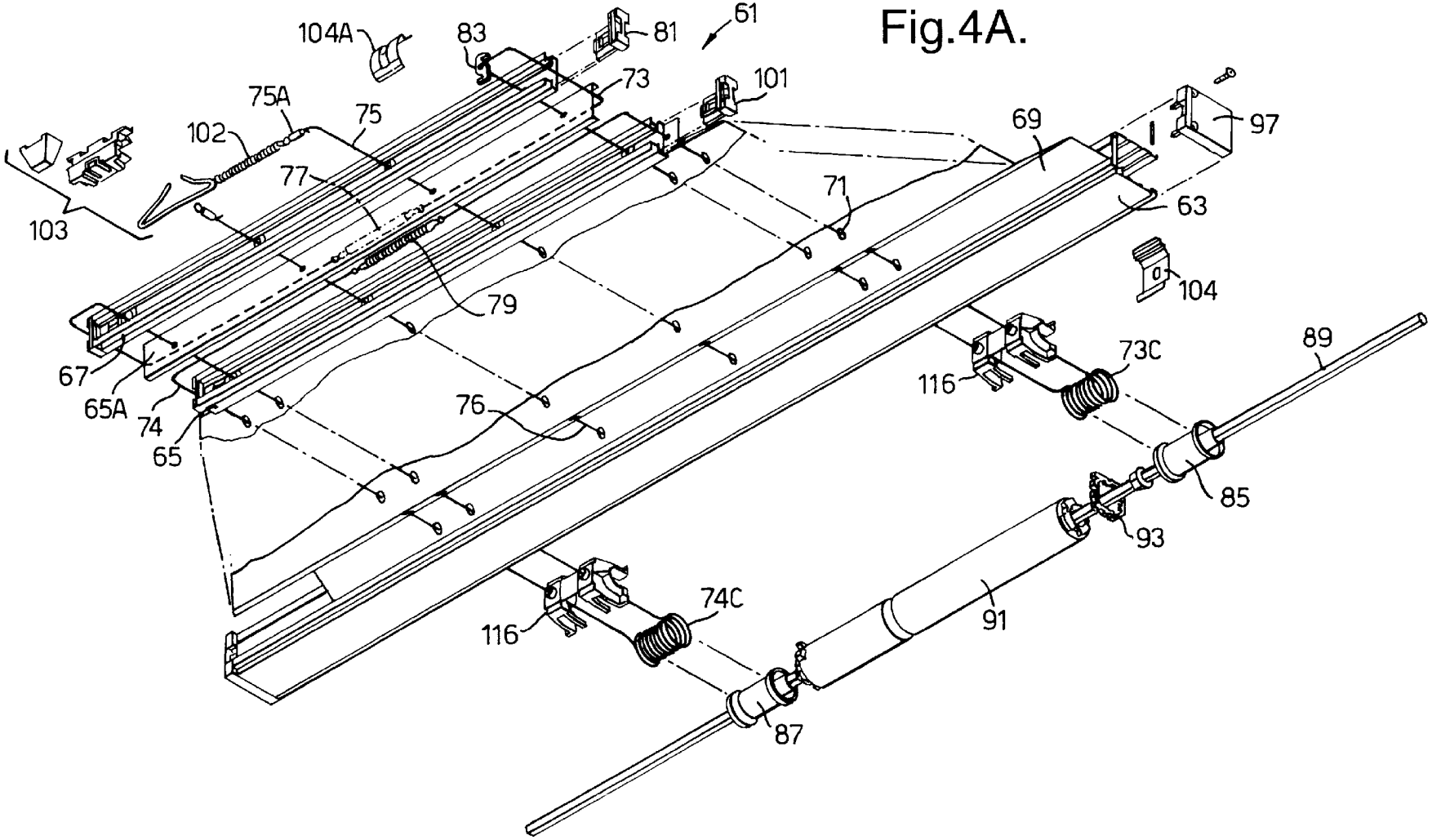
FIG. 4A is a detailed exploded view of a modified version of the second embodiment of the shade assembly of FIG. 4.

FIGS. 4 and 4A show a second embodiment of a shade assembly 61 of the invention, in which parts that are like those of the shade assembly 1 of FIGS. 1–3 are indicated by like names and by like reference numerals which differ by "60" from those of the shade assembly 1.

The shade assembly 61 of FIGS. 4 and 4A has a generally trapezoidal form to correspond to a trapezoidal window opening 62. The shade assembly 61 includes: a fixed rail 63 which is preferably a bottom rail; a movable rail 65; and a fixed auxiliary rail 67, which is preferably a top rail, as a guide member for the driving cords 73,74. Between the fixed rail 63 and the movable rail 65 is a trapezoidal shade 69 with a plurality of openings 71 for the passage of a pair of driving cords 73,74. The driving cords 73,74 are looped in a similar way to those of the shade assembly 1 of FIGS. 1–3 to extend between the movable rail 65 and winding drums 85,87 on a drive shaft 89 within the fixed rail 63. The drive shaft 89 is driven by an electric motor 91.

Figure 6:
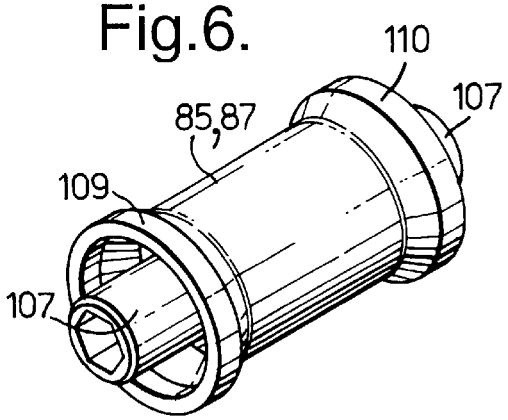
FIG. 6 is a perspective view of a second type of winding drum for use with the second embodiment of the shade assembly of FIGS. 4 and 4A.

The winding drums 85,87 of the shade assembly 61 of FIGS. 4 and 4A, which are identical components, differ slightly from the winding drums 25,27 of the shade assembly 1 of FIGS. 1–3. As shown in FIG. 5, the winding drums 25,27 of FIGS. 1–3 each have a journal extension 47 on only one of its axial ends. By comparison, as shown in FIG. 6, each winding drum 85,87 of FIGS. 4 and 4A has a journal extension 107 on both axial ends. However, the winding drums 25,27, like the winding drums 85,87, are provided with circumferential flanges 49,50 and 109,110, respectively, adjacent both axial ends.

As also seen from FIGS. 4 and 4A, the windings drums 85,87 are spaced away from the longitudinal ends of the fixed rail 63 and are supported there in separate cradles 116, together with the turns 73C,74C of the driving cords 73,74 wound about the winding drums. Each cradle 116 is formed by a pair of the bearing blocks 35, spaced longitudinally away from the adjacent end cap 97 of the fixed rail 63.

Figure 7:
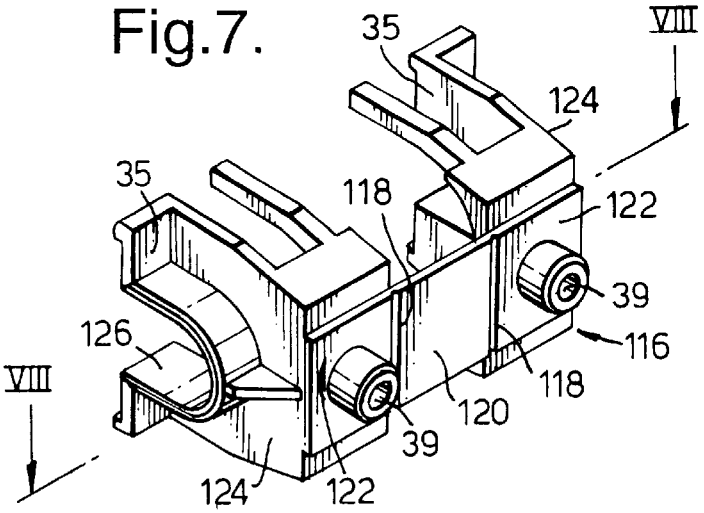
FIG. 7 is a perspective view of one form of bearing block suitable for use with both the first and second embodiments of shade assemblies.
Figure 8:
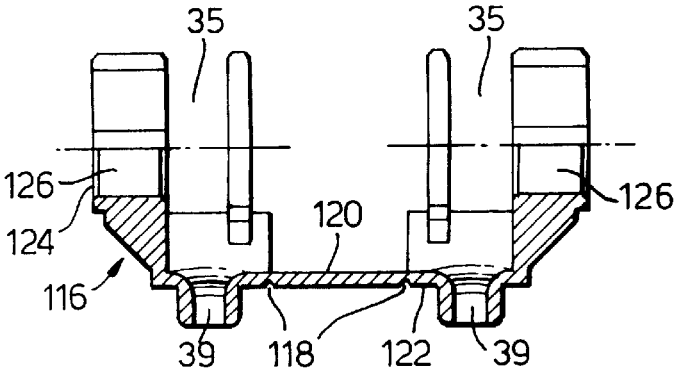
FIG. 8 is a longitudinal cross-section through the bearing block of FIG. 7 in the direction of arrows VIII—VIII.

The cradle 116 of this invention and the connection of its two bearing block sections 35 are shown in detail in FIGS. 7 and 8. The two bearing blocks 35 of the cradle 116 can be separated to form the individual bearing blocks 35 of FIGS. 1 and 2. In this regard, a pair of parallel break lines 118 are provided in a web portion 120 between the two bearing blocks 35 of the cradle 116.

The shade assembly 61 of FIG. 4A differs from that of FIG. 4 in having a cover strip 65A (shown as partially cut-away) which can be attached to the movable rail 65, adjacent the fixed auxiliary rail 67. The cover strip 65A serves to conceal the first and second tensioning springs 77,79 and the portions of the driving cords 73,74 within the movable rail 65.

The shade assembly 61 of FIG. 4A also differs from that of FIG. 4 in having its electric motor 91 positioned between the cradles 116 supporting the winding drums 85,87.

The shade assembly 61 of FIG. 4A further differs from that of FIG. 4 in having a pair of support cables 75,76 between the driving cords 73,74. One end 75A of one of the support cables 75 extends in a loop through the fixed rail 63 and then is attached to the left end of a third tension spring 102. The right end of the third tension spring 102 is attached to, and tensioned by, a tensioning slider 103 as described in EP 0 860 577.

The shade assembly 61 of FIG. 4A still further differs from that of FIG. 4 in having the cord end 73B,74B of each driving cord 73,74 guided through a fixed cord guide member in the form of a first conventional end cap 81 at each longitudinal end of the fixed auxiliary rail 67, then through a conventional grommet 83 in the fixed auxiliary rail 67, then through the fixed auxiliary rail itself and then returned from there to the fixed rail 63, via an opening in the movable rail 65.

The shade assembly 61 of FIG. 4A is also provided with brackets 104,104A, as described in EP 0 862 881, for mounting the adjacent fixed rail 63 and fixed auxiliary rail 67, respectively, to a support surface (not shown).

In accordance with this invention, the joined pair of bearing blocks 35, shown in FIG. 7, can be used as the cradle 116 in the shade assembly 61 of FIGS. 4 and 4A, or they can provide the separate bearing blocks 35 for the shade assembly 1 of FIGS. 1–3. In this regard, each winding drum 85,87 and its intermediate turns 73C,74C of one of the driving cords 73,74 can be received in an identical cradle 116 on opposite longitudinal sides within the fixed rail 63.

As shown in FIGS. 7 and 8, the cradle 116 includes: a pair of the bearing blocks 35 in side-by-side relationship, on opposite sides of the cradle 116; and the web portion 120 that is between the bearing blocks 35 and connects a base portion 122 of each bearing block. The pair of parallel break-lines 118 are provided in the web portion 120 for use in separating the bearing blocks 35 from each other. Each bearing block 35 also has a flange 124 extending perpendicularly from its base portion 122, preferably at opposite longitudinal ends of the cradle 116 remote from the break lines 118. A bearing recess 126 is provided in the top of each flange 124 to receive and rotatably support the pair of extended journals 107 of the winding drums 85,87 or the single extended journal 47 of the winding drums 25,27. The base portion 122 of each bearing block 35 of the cradle 116 also has one of the cord apertures or passages 39, preferably at one longitudinal end, particularly adjacent its flange 124. In the shade assembly 61 of FIGS. 4 and 4A where each cradle 116 is preferably used in its entirety, both cord apertures 39 are used for the passage of the two portions of a driving cord 73,74, whereas in the shade assembly 1 of FIGS. 1–3, only one portion of a driving cord 13,14 extends through a cord aperture 39 in each bearing block 35 and the other cord portion preferably extends through an opening in the end cap 37 so as to pass longitudinally of the end of the fixed rail 3.

This invention is, of course, not limited to the above-described embodiments which may be modified without departing from the scope of the invention or sacrificing all of its advantages. In this regard, the terms in the foregoing description and the following claims, such as "left", "right", "adjacent", "vertical", "longitudinal", "upper" and "lower", have been used only as relative terms to describe the relationships of the various elements of the architectural covering and bearing block of the invention. For example, the pleated shade 9 could be replaced by a conventional slatted or cellular type shade, such as a plurality of parallel blind slats carried by an appropriate number of ladder cords, i.e., a venetian blind.

What is claimed is:

1. A cradle for supporting a rotating member in a rail of an architectural covering; said cradle comprising:

a pair of bearing blocks, including a first bearing block and a second bearing block, said first and second bearing blocks positioned in side-by-side relationship, each of said bearing blocks including a base portion, wherein said base portion of said first bearing block is coplanar with said base portion of said second bearing block; and a web portion that integrally connects said base portion of each of said bearing blocks on opposite sides of said cradle and that has at least one break-line for separating said bearing blocks;

each of said bearing blocks further comprising a flange extending perpendicularly from its base portion and adapted to rotatably support said rotating member; and at least one of said base portions further comprising an aperture for receiving a driving cord therethrough.

2. A cradle according to claim 1, wherein said at least one break-line comprises a pair of substantially parallel break-lines provided in said web portion for separating said bearing blocks.

3. A cradle according to claim 1 or 2 wherein each of said base portions has at least one of said apertures to receive said driving cord therethrough.

4. A cradle according to claim 1 wherein the rotating member is a rotary drive spool having a journal, and each flange further comprises a bearing recess effective to rotatably support said journal.

5. A cradle according to claim 1 wherein said flanges are on opposite ends of said cradle remote from said at least one break-line.

6. An architectural covering, comprising:

a fixed first rail;

a movable second rail extending parallel to said fixed first rail;

a fixed cord guide member spaced from said fixed first rail and positioned beyond said movable second rail;

a collapsible and extendable blind which is positioned between said fixed first rail and said movable second rail;

at least one rotary drive spool mounted on said fixed first rail;

at least one driving cord that is wound on said rotary drive spool and is operatively connected to said movable second rail;

a cradle for supporting said at least one rotary drive spool, said cradle comprising:

a pair of bearing blocks positioned in side-by-side relationship, each of said bearing blocks including a base portion and a flange extending perpendicularly from its said base portion, said flanges being adapted to rotatably support said at least one rotary drive spool, and at least one of said base portions further comprising an aperture for receiving said at least one driving cord therethrough; and a web portion that connects said base portion of each of said bearing blocks on opposite sides of said cradle and that has at least one break-line for separating said bearing blocks; and means for reversibly rotating said rotary drive spool to drive said at least one driving cord and to effect movement of said movable second rail to collapse or extend said blind;

wherein said at least one driving cord extends in an endless loop, incorporating at least one tension spring, from said rotary drive spool towards said movable second rail, then towards said guide member, and then from said guide member back to said rotary drive spool.

7. An architectural covering according to claim 6 and further comprising a fixed auxiliary third rail that is spaced from and parallel to said movable second rail, and is parallel to said fixed first rail, and is beyond said movable second rail and wherein said guide member is mounted to said fixed auxiliary third rail.

8. An architectural covering according to claim 7 wherein said fixed cord guide member is located at a longitudinal end of said fixed auxiliary third rail.

9. An architectural covering according to claim 8, wherein said at least one driving cord comprises a pair of parallel driving cords, and wherein said architectural covering further comprises a second fixed cord guide member located on an opposite longitudinal end of said fixed auxiliary third rail.

10. An architectural covering according to claim 6, wherein said at least one break-line comprises a pair of substantially parallel break-lines provided in said web portion for separating said bearing blocks.

11. An architectural covering according to claim 6 or 10, wherein each of said base portions has at least one of said apertures for receiving said at least one driving cord therethrough.

12. An architectural covering according to claim 6, wherein said at least one rotary drive spool has a journal, and each flange further comprises a bearing recess effective to rotatably support said journal.

13. An architectural covering according to claim 6, wherein said flanges are on opposite ends of said cradle remote from said at least one break-line.

14. A bearing block for supporting a rotating member in a rail of an architectural covering, said bearing block comprising a base portion having an aperture therein adapted to receive a driving cord therethrough; and a flange extending perpendicularly from said base portion and adapted to rotatably support said rotating member; wherein an edge of said base portion most remote from said flange is beveled upwardly away from said flange.

15. An architectural covering, comprising:

a fixed first rail;

a movable second rail extending parallel to said fixed first rail;

a fixed cord guide member spaced from said fixed first rail and positioned beyond said movable second rail;

a collapsible and extendable blind which is positioned between said fixed first rail and said movable second rail;

a rotary drive spool mounted on said fixed first rail;

a driving cord that is wound on said rotary drive spool and is operatively connected to said movable second rail;

a cradle comprising a bearing block having a base portion, wherein a flange extends perpendicularly from said base portion to rotatably supports said rotary drive spool, and wherein said base portion further comprises an aperture to receive said driving cord therethrough; and means for reversibly rotating said rotary drive spool to drive said driving cord and to effect movement of said movable second rail to collapse or extend said blind;

wherein said driving cord extends in an endless loop, incorporating at least one tension spring, from said rotary drive spool towards said movable second rail, then towards said guide member, and then from said guide member back to said rotary drive spool.

16. An architectural covering according to claim 15, wherein said fixed first rail has longitudinal ends and said at least one rotary drive spool is spaced from the longitudinal ends of the fixed first rail.

* * * * *